US011209170B2

(12) United States Patent
Zhou

(10) Patent No.: US 11,209,170 B2
(45) Date of Patent: Dec. 28, 2021

(54) GAS FIREPLACE COMBUSTION DEVICE STRUCTURE

(71) Applicant: NINGBO RICHEN ELECTRICAL APPLIANCE CO., LTD, Ningbo PR (CN)

(72) Inventor: Yin Zhou, Ningbo PR (CN)

(73) Assignee: NINGBO RICHEN ELECTRICAL APPLIANCE CO., LTD., Ningbo (CN)

( * ) Notice: Subject to any disclaimer, the term of this patent is extended or adjusted under 35 U.S.C. 154(b) by 200 days.

(21) Appl. No.: 16/556,966

(22) Filed: Aug. 30, 2019

(65) Prior Publication Data

US 2020/0363066 A1 Nov. 19, 2020

(51) Int. Cl.
*F24C 3/02* (2006.01)
*F24C 3/00* (2006.01)

(52) U.S. Cl.
CPC ..... *F24C 3/022* (2013.01); *F24C 3/002* (2013.01)

(58) Field of Classification Search
CPC ..... F24C 3/002; F24C 3/022; F24C 3/006; F24B 5/026
See application file for complete search history.

(56) References Cited

U.S. PATENT DOCUMENTS 4,976,253 A * 12/1990 Beal ..... F24C 3/006 126/512
5,000,162 A * 3/1991 Shimek ..... F24C 3/006 126/512
5,092,313 A * 3/1992 Blackburn ..... F24B 1/1808 126/512
5,320,520 A * 6/1994 Barth ..... F24C 3/006 126/512
5,429,495 A * 7/1995 Shimek ..... F24C 3/006 126/512
5,452,709 A * 9/1995 Mealer ..... F24C 3/006 126/512
5,479,916 A * 1/1996 Shimek ..... F24C 3/004 126/512
5,571,008 A * 11/1996 Richardson ..... F23D 14/02 126/512
5,647,341 A * 7/1997 Langman ..... F24C 3/004 126/512

(Continued)

*Primary Examiner* — Alfred Basichas
(74) *Attorney, Agent, or Firm* — Tarolli, Sundheim, Covell & Tummino LLP

(57) ABSTRACT

A gas fireplace combustion device structure includes a simulated solid fuel and a combustor under the simulated solid fuel. The combustor has a fire exit hole facing the simulated solid fuel, a combustion air inlet passage under the combustor, and a specific slot at the combustor to define a third combustion air inlet. A partition is installed under the combustor; a second combustion air inlet leading to fire exit hole is formed between the partition and the combustor; the combustion air inlet passage is provided for supplying air to the second and third combustion air inlets; a combustion air slot is formed at the middle of the simulated solid fuel to resupply combustion air to the flame above the simulated solid fuel in order to achieve a two-time sectional combustion. This invention can control and resupply combustion air to the flames in different areas to improve the combustion effect.

8 Claims, 11 Drawing Sheets

(56) References Cited

U.S. PATENT DOCUMENTS

| | | | | |
|---|---|---|---|---|
| 5,931,154 | A * | 8/1999 | Hussong | F24C 3/006 126/512 |
| 6,006,742 | A * | 12/1999 | Jamieson | F23D 14/10 126/512 |
| 6,260,548 | B1 * | 7/2001 | Wade | F24C 3/006 126/512 |
| 2010/0083955 | A1 * | 4/2010 | Gorby | F24C 3/006 126/85 R |

* cited by examiner

GAS FIREPLACE COMBUSTION DEVICE STRUCTURE

RELATED APPLICATIONS

The present invention is a Nonprovisional Application under 35 USC 111(a), claiming priority to Serial No. CN 201920700259.5, filed on 15 May 2019 and CN 201910407368.2, filed on 15 May 2019, the entirety of both of which are incorporated herein by reference.

FIELD OF INVENTION

The present invention relates to the field of a combustion device structure of a gas fireplace, in particular to a combustion device structure having two or more combustor assemblies which is installed to the gas fireplace.

BACKGROUND OF INVENTION

1. Description of the Related Art

Gas fireplace is a heating device that consumes clean energy. Since the gas fireplace not just provides heating only, but also provides real flames for viewing (compared with heaters such as wall mounted boilers without any enjoyable visual effect) and gives both heating and decorating effects, therefore the gas fireplace is loved by consumers extensively. In general, the conventional gas fireplace comes with a combustor which is a single-cavity structure, a plurality of openings formed on the surface of the combustor cavity to serve as fire holes for burning flames, and a plurality of coal beds or simulated solid fuels disposed above the combustor or around the combustor. Since the single combustor cannot control the flames coming from different directions, therefore the conventional gas fireplace is lack of layering and provides an insufficient ornamental effect. Some new gas fireplaces with the structure of two or more combustors are introduced, but the two or more combustors are usually connected tightly with each other under the same simulated solid fuel, so that the upper simulated solid fuel will press and cover the combustor completely.

Furthermore, when people are watching the fireplace, it is necessary to provide a flame with brighter colors to achieve the best viewing effect, and it is necessary to control the combustion air while the fuels are burning, so that the combustion will be sufficient, but not too much. In addition, nitrogen oxides are produced during fuel combustion, and the nitrogen oxides are harmful to human beings and the environment, and it is necessary to reduce the content of nitrogen oxides during fuel combustion. To control the content of nitrogen oxides, we can either control the amount of resupplied air or the temperature of the flame during the combustion.

Regardless of the single combustor or the two or more combustors installed in a furnace chamber of a conventional gas fireplace, there is no combustion air inlet passage near the fuel combustion area of the combustor, so that there is no control of the combustion air for the flames at different positions. Since the amount of required combustion air varies with different areas of the furnace chamber, therefore the combustion air in some areas such as the area near the fire exit hole of the combustor will be insufficient, and the combustion area in other areas will be too much. As a result, the combustion is poor and yellow flame is produced easily in the areas with insufficient combustion; and the flame temperature is high and a large quantity of nitrogen oxides is produced easily in the area with too much combustion air.

2. Summary of the Invention

Technical Problems to be Solved

It is a primary objective of the present invention to overcome the aforementioned drawbacks of the conventional gas fireplace by providing a gas fireplace combustion device structure capable of controlling different layers of the flame and controlling the amount of combustion air to different areas during fuel combustion to achieve a sectional fuel combustion effect, and this structure not just gives a sufficient combustion and a bright flame only, but also effectively reduces the content of nitrogen oxides produced during fuel combustion.

Technical Solution

To achieve the aforementioned and other objectives, the present invention provides a gas fireplace combustion device structure comprising: a combustor and a simulated solid fuel, characterized in that the combustor has a fuel gas inlet formed thereon, and the simulated solid fuel is disposed on an upper surface of the combustor, wherein the combustor may be a one-piece combustor or two or more combustor assemblies integrated as a whole and installed at a position under the simulated solid fuel. The combustor has a fire exit hole facing at least one of the four sides of the simulated solid fuel, and an independent combustion air inlet passage disposed under the combustor, and the combustion air inlet passage has an entrance disposed at the outside and/or outer bottom of the furnace chamber of the gas fireplace, and a third combustion air inlet is formed at the middle of the combustor, wherein the third combustion air inlet is a one-piece combustor, or two or more combustor assemblies integrated as a whole, and the combustion air inlet passage and the third combustion air inlet communicate to each other. The simulated solid fuel may be one-piece or two assemblies combined with each other, and the simulated solid fuel has a combustion air slot formed thereon, and the combustion air slot and the third combustion air inlet communicate to each other directly.

Further, a partition is installed under the combustor, and a second combustion air inlet leading to the fire exit hole is formed between the partition and a surface of the combustor, and the second combustion air inlet and the combustion air inlet passage communicate to each other.

During combustion, a combustible gas at the fire exit hole is ignited, and the combustion air resupplied in the second combustion air inlet is used for the primary combustion, and then combustion air is resupplied from the third combustion air inlet and the combustion air slot to the area above the simulated solid fuel, the middle area of the flame, and the area above the flame for the secondary combustion of the fuel, so as to achieve a two-times sectional combustion effect and control the resupply quantity of combustion air and the flame temperature of fuel combustion at different areas.

Further, the third combustion air inlet is a grooved opening having an average width of 2 mm~30 mm.

Further, the combustion air slot is an irregular strip shaped slot, one or more small holes, or a combination of the irregular strip shaped slot and small holes.

Further, the combustion air slot is a slit or a gap between two or more simulated solid fuels.

Further, the combustion air slot comes with the quantity of one or more, and the combustion air slot has an average width of 1 mm~25 mm.

Further, the combustion air inlet passage is installed around the periphery of the fuel gas inlet.

Beneficial Effects

Compared with the prior art, the present invention has the following advantages:

In the gas fireplace combustion device structure of the present invention, the third combustion air inlet is designed in the single combustor and/or two or more combustors installed under the same simulated solid fuel, and the combustion air slot is designed at the middle of the simulated solid fuel, and the second combustion air inlet is designed under the combustor and in an area near the fire exit hole for resupplying and controlling the combustion air to different areas during fuel combustion, so that the invention not just provides a sufficient combustion only, but also reduces the produced nitrogen oxides by the lower combustion air temperature and the controlled flame temperature at different areas.

Figure 1:
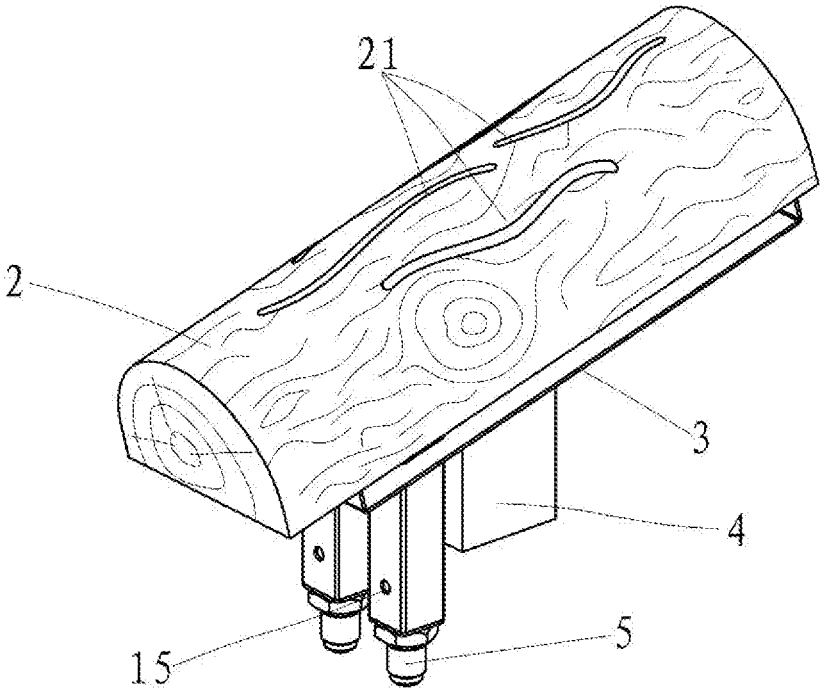
FIG. 1 is a perspective view of a first embodiment of the present invention.
Figure 2:
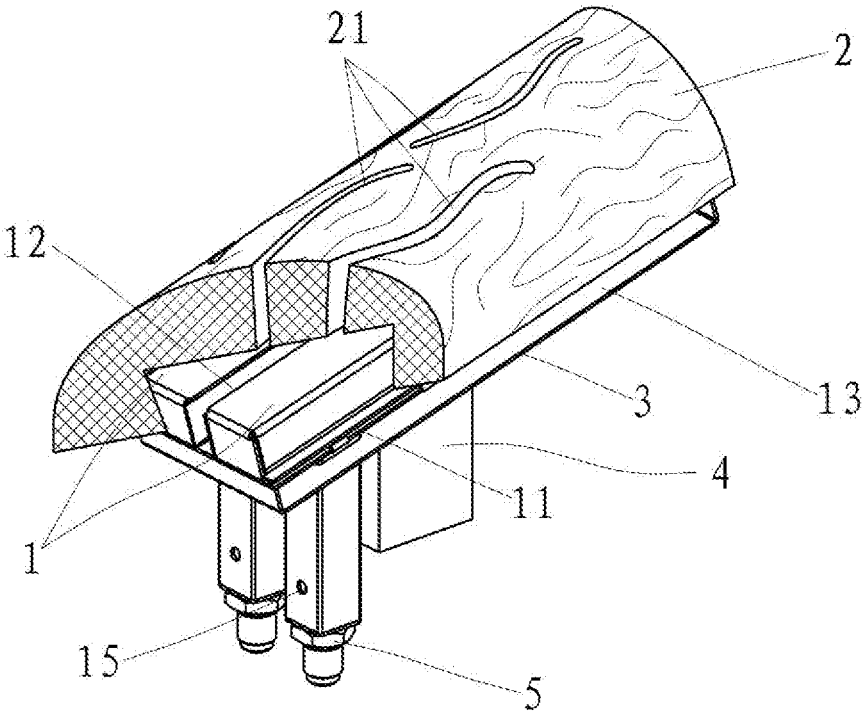
FIG. 2 is a partial cross-sectional view of the first embodiment of the present invention.
Figure 3:
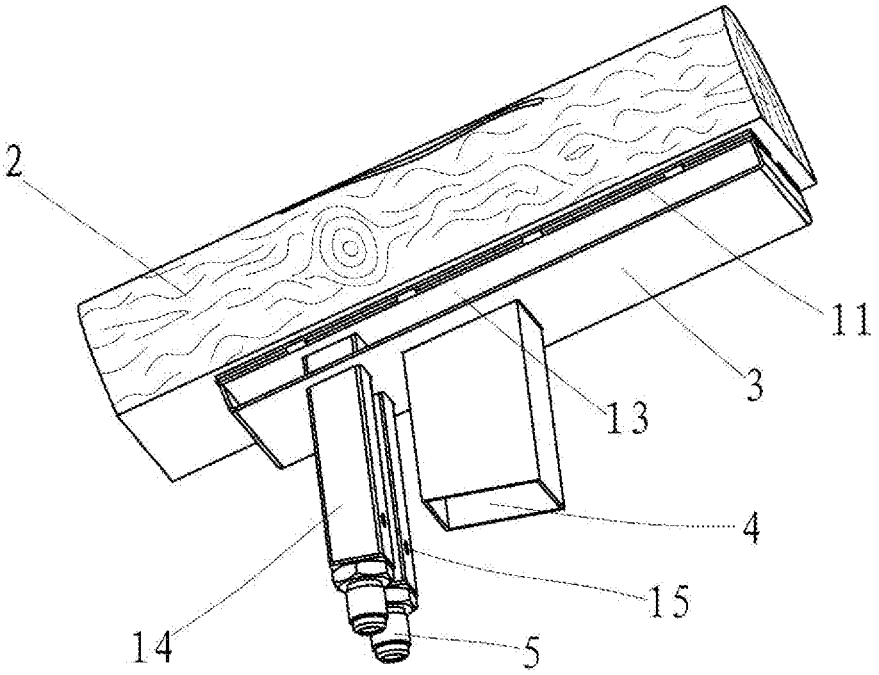
FIG. 3 is another perspective view of the first embodiment of the present invention.
Figure 4:
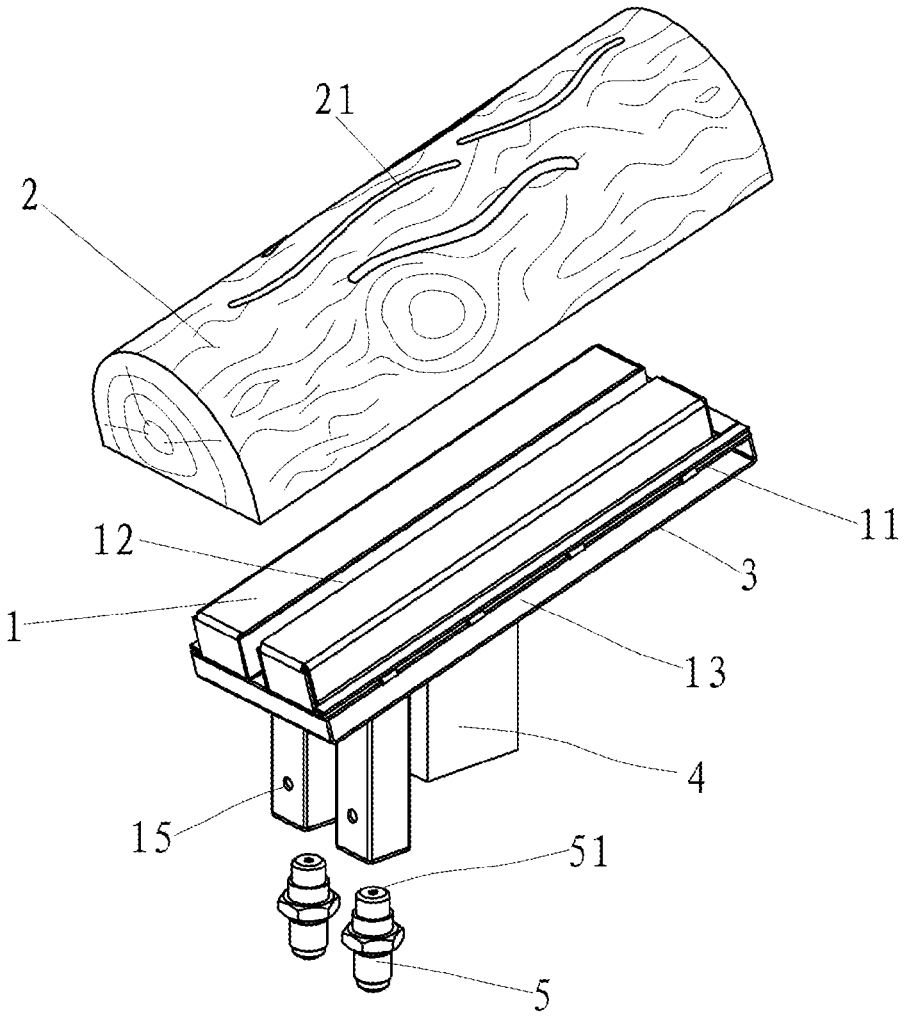
FIG. 4 is an exploded view of the first embodiment of the present invention.
Figure 5:
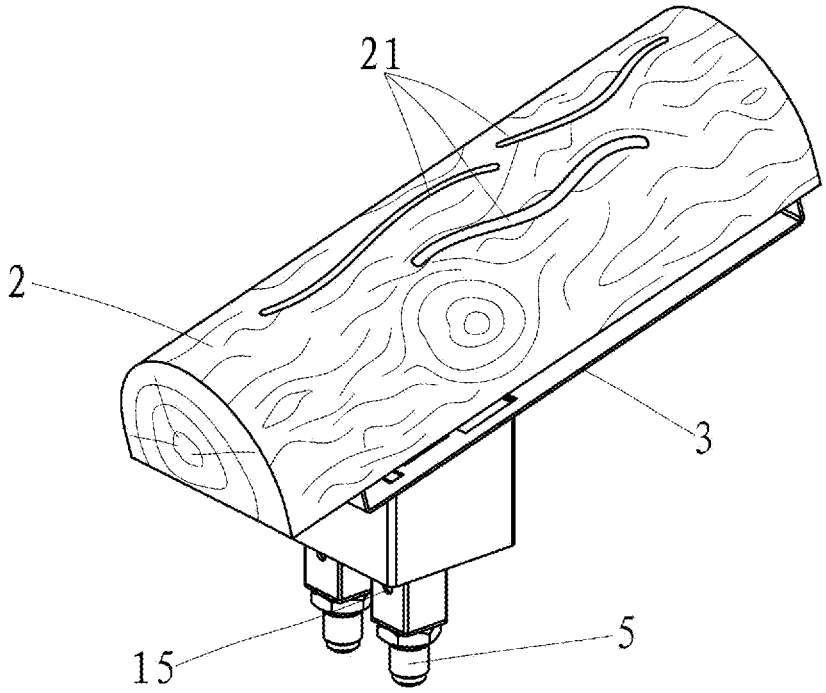
FIG. 5 is a perspective view of a second embodiment of the present invention.
Figure 6:
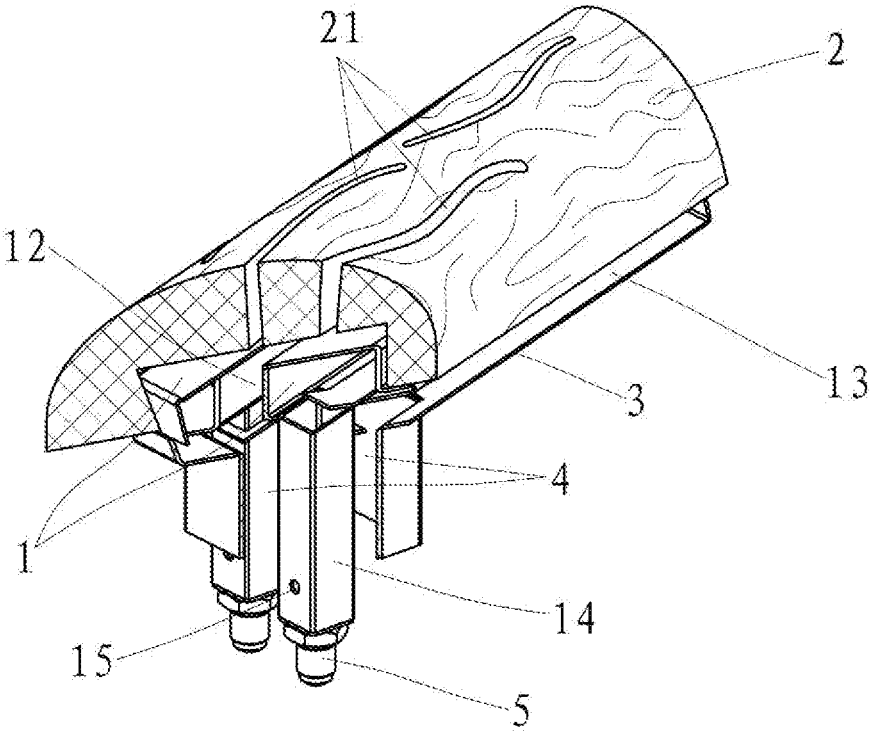
FIG. 6 is a partial cross-sectional view of the second embodiment of the present invention.
Figure 7:
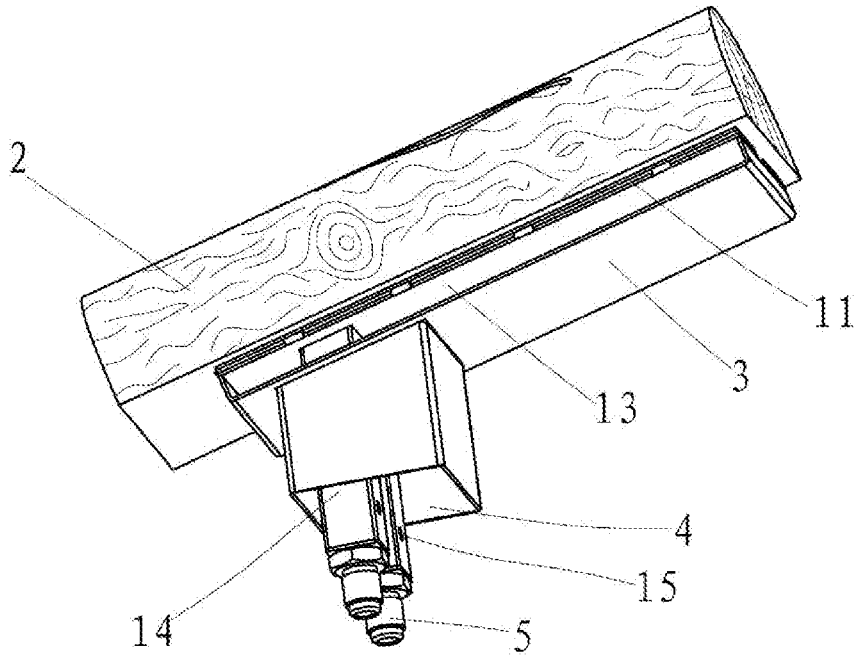
FIG. 7 is another perspective view of the second embodiment of the present invention.
Figure 8:
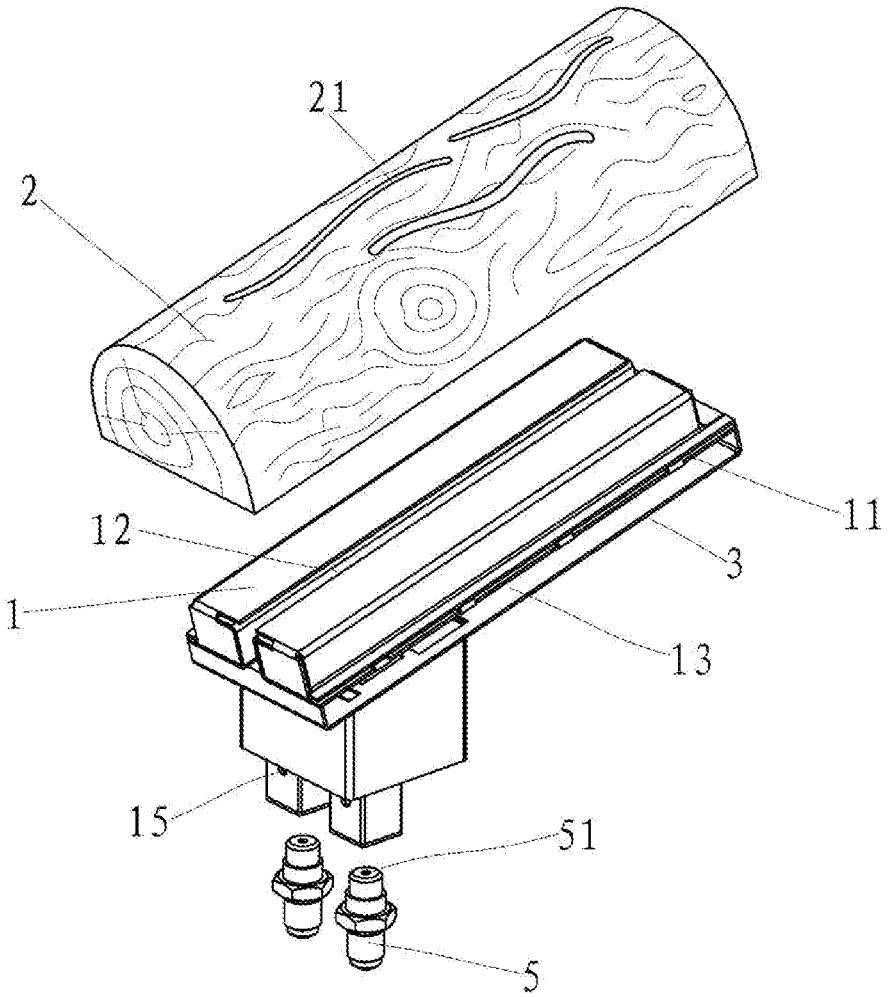
FIG. 8 is an exploded view of the second embodiment of the present invention.
Figure 9:
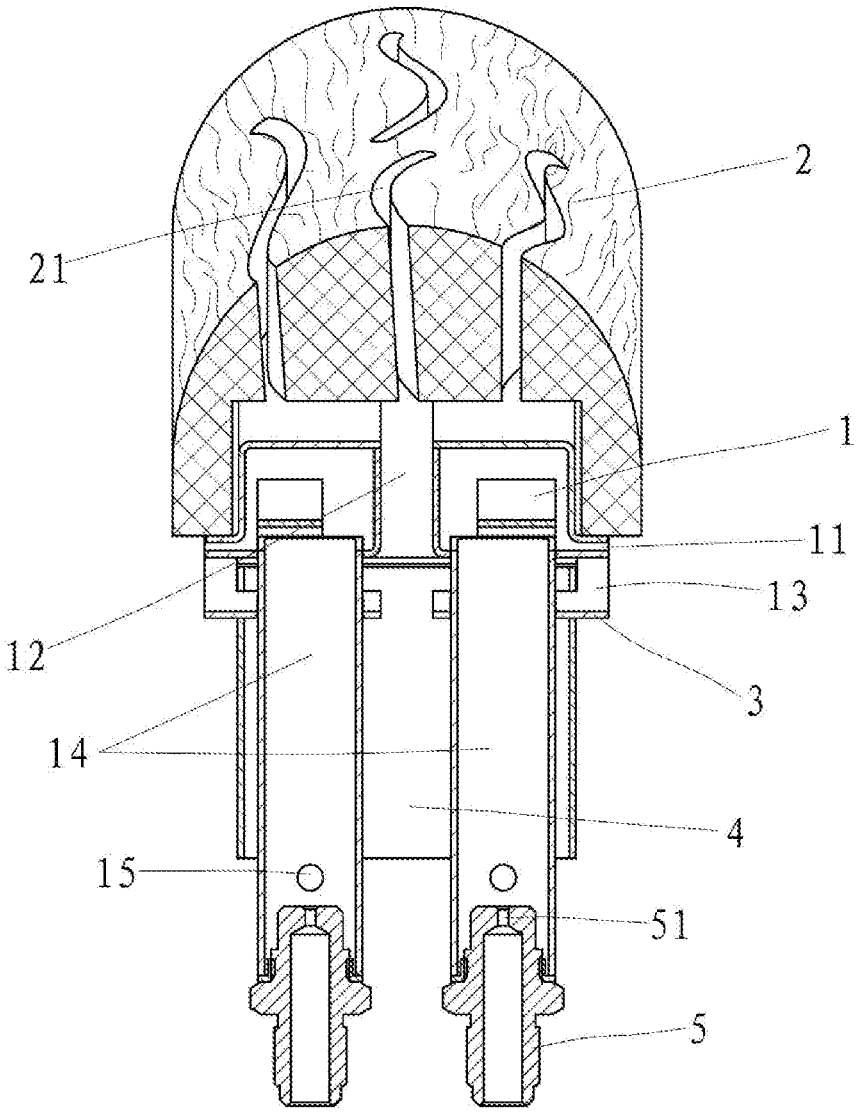
FIG. 9 is a half section view of the second embodiment of the present invention.
Figure 10:
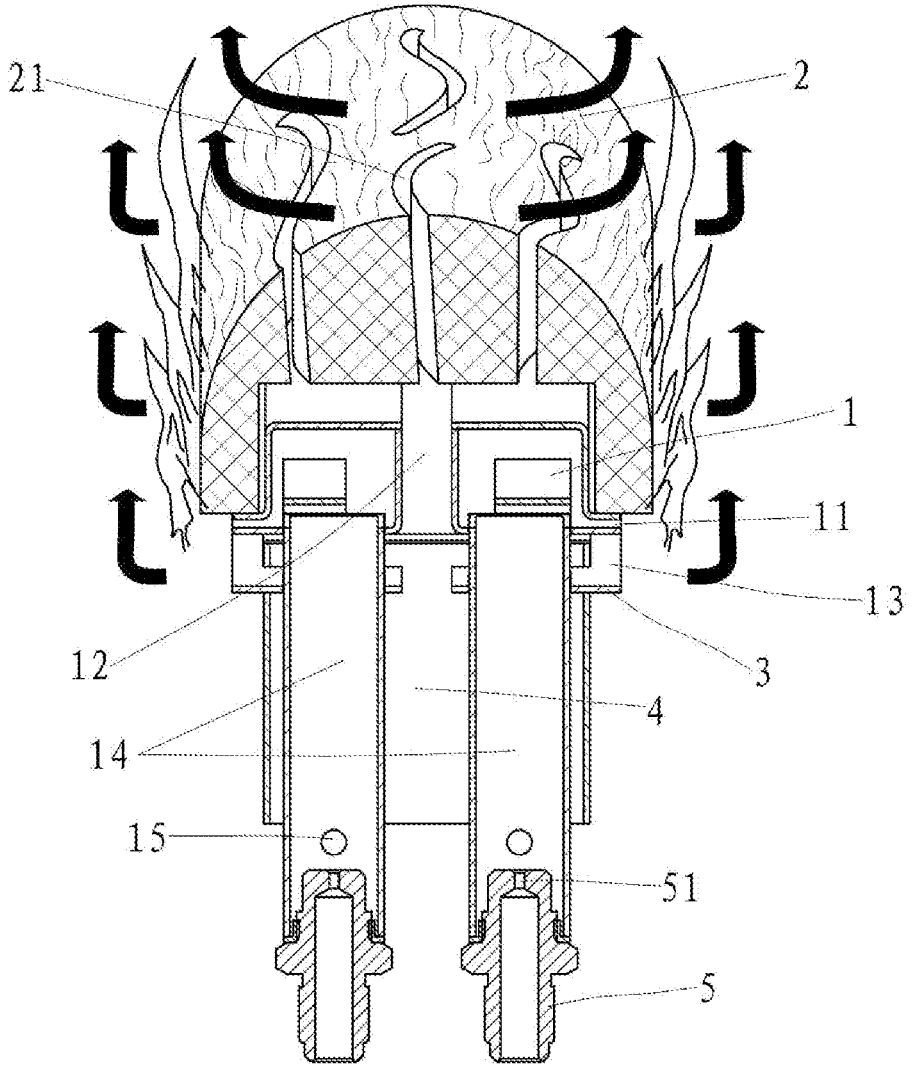
FIG. 10 is a schematic view showing the fuel combustion and the flow of combustion air in accordance with the second embodiment of the present invention.

Brief Description of Numerals in the Drawings: 1—combustor; 2—simulated solid fuel; 3—partition; 4—combustion air inlet passage; 5—nozzle; 6—auxiliary combustion inlet; 11—fire exit hole; 12—third combustion air inlet; 13—second combustion air inlet; 14—fuel gas inlet; 15—first combustion air inlet; 21—combustion air slot; and 51—fuel ejection outlet.

DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Embodiment 1

With reference to FIGS. 1 to 4 for a gas fireplace combustion device structure in accordance with the first embodiment of the present invention, the gas fireplace combustion device structure comprises a combustor 1 and a simulated solid fuel 2, and this embodiment has pairs of combustors 1 disposed under the simulated solid fuel 2, and the simulated solid fuel 2 is disposed on an upper surface of the combustor 1. A combustion air inlet passage 4 is disposed under the combustor 1 and configured combustion air inlet passage 4 to be parallel to a fuel gas inlet 14 of the combustor 1, and the combustion air inlet passage 4 has an entrance outside a furnace chamber, and each of the paired combustors 1 has a fire exit hole 11 formed thereon. In this embodiment, the fire exit holes 11 are configured to be facing both sides of the simulated solid fuel 2 respectively, and a third combustion air inlet 12 is formed in an interval between the paired combustors 1, and the third combustion air inlet 12 has an average width of 2 mm~30 mm (which is approximately equal to 9 mm in this embodiment) and a partition 3 is installed under the combustor 1, and a second combustion air inlet 13 leading to the fire exit hole 11 is formed between the partition 3 and a lower surface of the combustor 1, and the combustion air inlet passage 4 communicates to the third combustion air inlet 12 and the second combustion air inlet 13. The simulated solid fuel 2 has a combustion air slot 21 formed thereon, and the combustion air slot 21 communicates to the third combustion air inlet 12 directly, and the combustion air slot 21 is an irregular stripe shaped slot with an average width of 1 mm~25 mm (which is approximately equal to 4 mm in this embodiment). The fuel gas inlet 14 has nozzle 5 coupled thereto, and the nozzle 5 has a fuel ejection outlet 51 formed thereon and the fuel gas inlet 14 has a first combustion air inlet 15 formed thereon.

During combustion, the combustible gas is ejected from the fuel ejection outlet 51 of the nozzle 5 and entered into the fuel gas inlet 14. According to the Venturi effect, the ejected combustible gas attracts air to enter into the fuel gas inlet 14 from the first combustion air inlet 15 quickly, so that the combustible gas and air are pre-mixed in the fuel gas inlet 14 and then entered from the fuel gas inlet 14 into the cavity of the combustor 1, and sprayed out from fire exit hole 11 and finally ignited. Now, the flame burns on both sides of the simulated solid fuel 2. In the meantime, the combustion air enters to the bottom of the combustor 1 from the combustion air inlet passage 4, and then passes through the second combustion air inlet 13 to reach the fire exit hole 11 to help burning the flame. Now, a primary combustion of the combustible gas is carried out at the fire exit hole 13. The flame of the primary combustion of the combustible gas moves upward along the simulated solid fuel 2 and passes through the third combustion air inlet 12 and the combustion air slot 21 to reach the third combustion air above the simulated solid fuel 2, so as to resupply combustible air to the bottom of the flame and carry out a secondary combustion of the flame. With the two-time sectional combustion of the flame, the amount of resupplied combustion air and the temperature of the flame at different areas during fuel combustion can be controlled reasonably to reduce the content of nitrogen oxides produced by the fuel combustion while making the color of the flame brighter and cleaner.

Embodiment 2

With reference to FIGS. 5 to 11 for a gas fireplace combustion device structure in accordance with the second embodiment of the present invention, the difference between this embodiment and the first embodiment resides on that the combustion air inlet passage 4 is installed around the fuel gas inlet 14 of the combustor 1, and such arrangement not only saves space, but also allows the combustion air to enter from the combustion air inlet passage 4 into the third combustion air inlet 12 and the second combustion air inlet 13 more uniformly.

Figure 11:
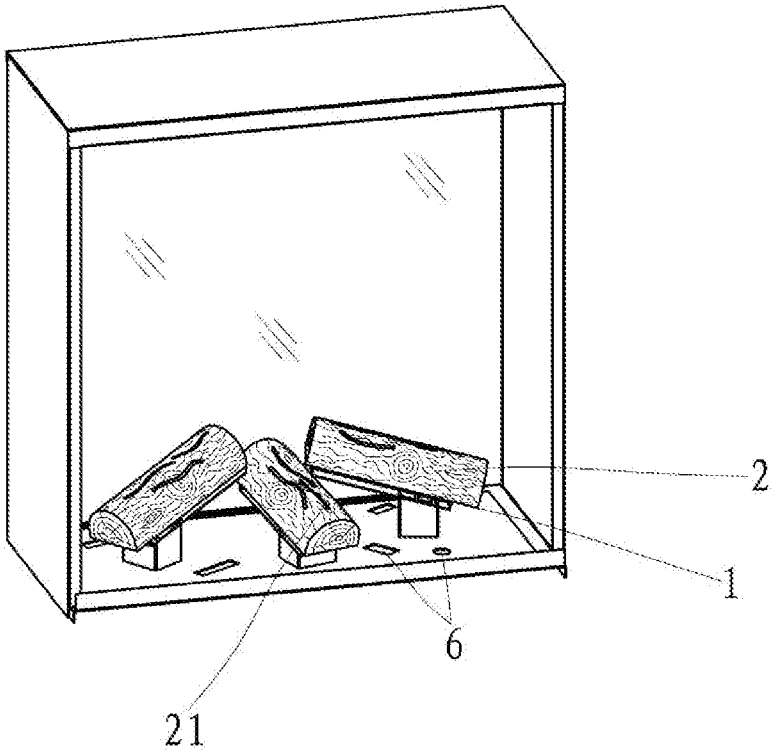
FIG. 11 is a schematic view of a gas fireplace having a plurality of combustion device structures installed in a furnace chamber in accordance with the second embodiment of the present invention.

With reference to FIG. 11 for a schematic view of a gas fireplace having a plurality of combustion device structures installed in a furnace chamber in accordance with the second embodiment of the present invention, the combustion air inlet passage 4 has an entrance communicating to the outer bottom of the furnace chamber, and an auxiliary combustion inlet 6 formed on a bottom plate of the combustion device installed to the gas fireplace of the second embodiment is provided for supplying combustion air for the whole operation of the gas fireplace.

Embodiment 3

Figure 12:
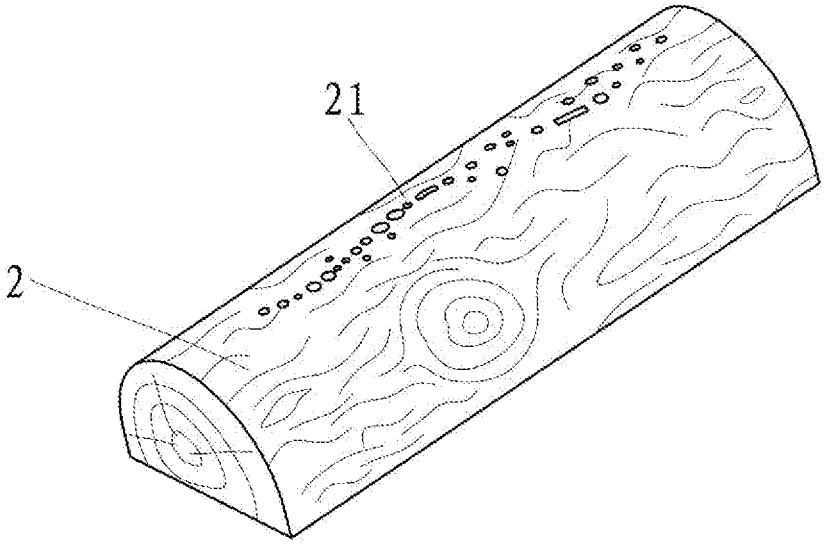
FIG. 12 is a schematic view of a simulated solid fuel in a gas fireplace in accordance with a third embodiment of the present invention.

In FIG. 12 the combustion air slot 21 is comprised of a plurality of irregular small holes.

Embodiment 4

Figure 13:
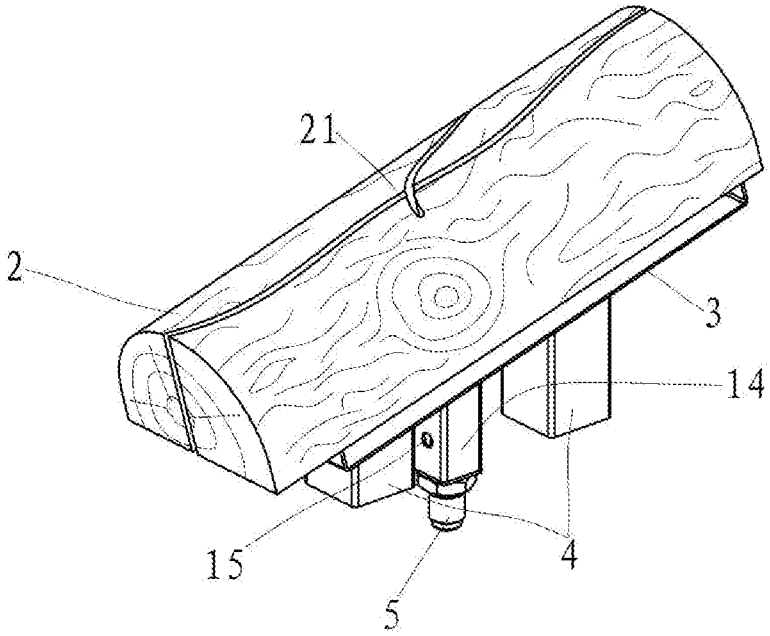
FIG. 13 is a perspective view of a single simulated solid fuel in a fourth embodiment of the present invention.
Figure 14:
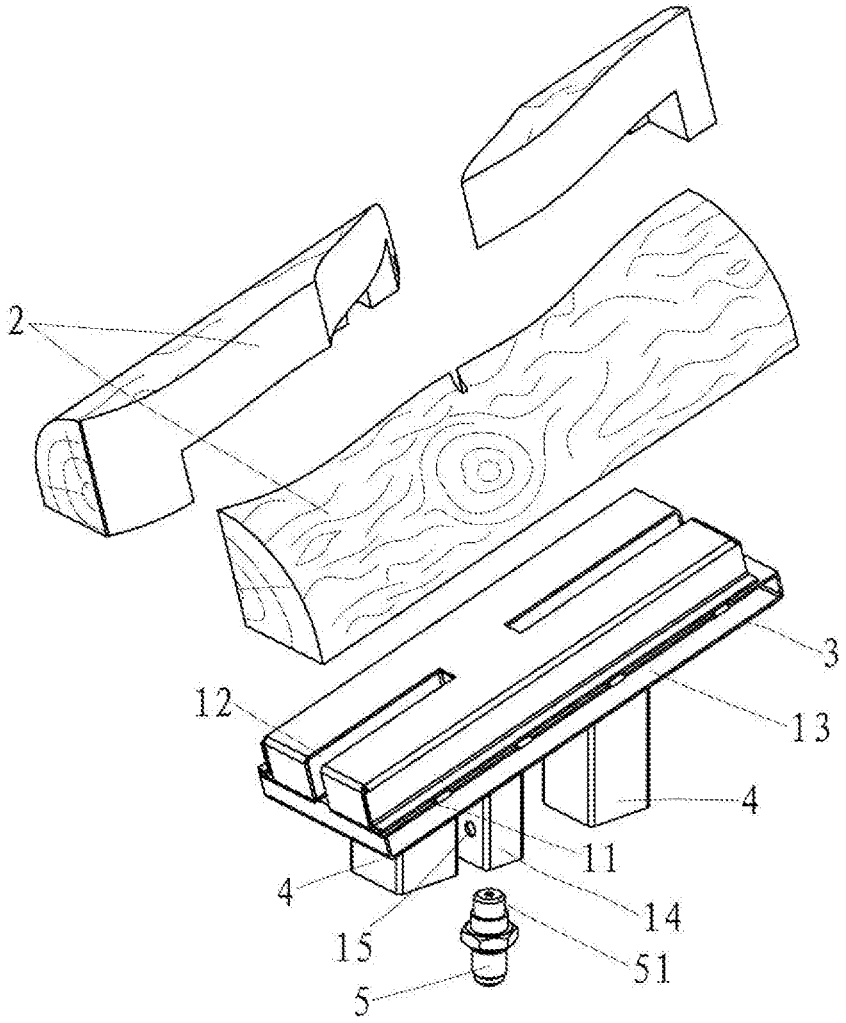
FIG. 14 is an exploded view of a single simulated solid fuel in the fourth embodiment of the present invention.

In FIGS. 13 and 14, the simulated solid fuel 2 is formed by combining three pieces, and the combustion air slot 21 is a gap formed between the three combined simulated solid fuels 2, and the combustor 1 is one-piece installed under the simulated solid fuel 2, and the third combustion air inlet 12 is formed at the middle of the combustor 1, and there are two combustion air inlet passages 4 configured to be parallel to the fuel gas inlet 14.

While the invention has been described by means of specific embodiments, numerous modifications and variations could be made thereto by those skilled in the art without departing from the scope and spirit of the invention set forth in the claims.

What is claimed is:

1. A gas fireplace combustion device structure, comprising;

a combustor; and a simulated solid fuel, wherein the combustor is installed under the simulated solid fuel, and a fire exit hole is formed on the combustor and configured to face at least one side of the periphery of the simulated solid fuel, and a combustion air inlet passage is disposed under the combustor, and wherein the combustor has a slot formed at the middle thereof to form a combustion air inlet, and the combustion air inlet passage communicates to the combustion air inlet, and the simulated solid fuel has a combustion air slot formed thereon, and the combustion air slot and the combustion air inlet communicate with each other directly.

2. The gas fireplace combustion device structure of claim 1, wherein the combustor has a partition disposed thereunder, and a further combustion air inlet leading to the fire exit hole is formed between the partition and a lower surface of the combustor lower surface, and the further combustion air inlet and the combustion air inlet passage communicate with each other.

3. The gas fireplace combustion device structure of claim 1, wherein the combustion air slot is an irregular shaped strip slot, or one or more small holes, or a combination of the irregular shaped strip slot and the small holes.

4. The gas fireplace combustion device structure of claim 3, wherein the quantity of the combustion air slot is one, two, or more.

5. The gas fireplace combustion device structure of claim 1, wherein the simulated solid fuel is formed by combining two or more pieces.

6. The gas fireplace combustion device structure of claim 5, wherein the combustion air slot is a slit or a gap between two or more simulated solid fuels.

7. The gas fireplace combustion device structure according to claim 1, wherein the combustion air slot has an average width of 1 mm~25 mm.

8. The gas fireplace combustion device structure claim 1, wherein the combustion air inlet is a grooved opening having an average width of 2 mm~30 mm.

* * * * *